United States Patent [19]

Adams

[11] 4,452,460

[45] Jun. 5, 1984

[54] ARROWHEAD CONSTRUCTION

[76] Inventor: Claude L. Adams, 12114 Park St., Cerritos, Calif. 90701

[21] Appl. No.: 443,233

[22] Filed: Nov. 22, 1982

[51] Int. Cl.[3] ..... F41B 5/02

[52] U.S. Cl. ..... 273/422

[58] Field of Search ..... 273/421, 422; 43/6

[56] References Cited

U.S. PATENT DOCUMENTS

| | | | |
|---|---|---|---|
| 2,568,417 | 9/1951 | Steinbacher | 273/421 |
| 3,578,328 | 5/1971 | Rickey | 273/421 |
| 3,756,600 | 9/1973 | Maleski | 273/422 |
| 3,915,455 | 10/1975 | Savora | 273/422 |
| 4,036,499 | 7/1977 | Sherwin | 273/422 |
| 4,166,619 | 9/1979 | Bergmann et al. | 273/421 X |

*Primary Examiner*—Paul E. Shapiro

*Attorney, Agent, or Firm*—Dominick Nardelli

[57] ABSTRACT

An arrowhead, with a conoidal, dowel-like body and a point to provide sufficient penetration, has at least two pivotable sharp blades disposed aft of the point and symetrical about the body. The blades are triangular and are pivotably mounted to the body by their aft or rear angles and extend radially outward with one edge of the blade disposed against the body so that one of the acute angles of each blade points forward. In a preferred embodiment, each blade is slightly recessed within an axially parallel slot and the pivoting function is formed by a ring threaded through the respective aft angles of the blades. In turn, the ring is coaxially disposed around the body and suitably secure in place to prevent axial movement thereof.

1 Claim, 7 Drawing Figures

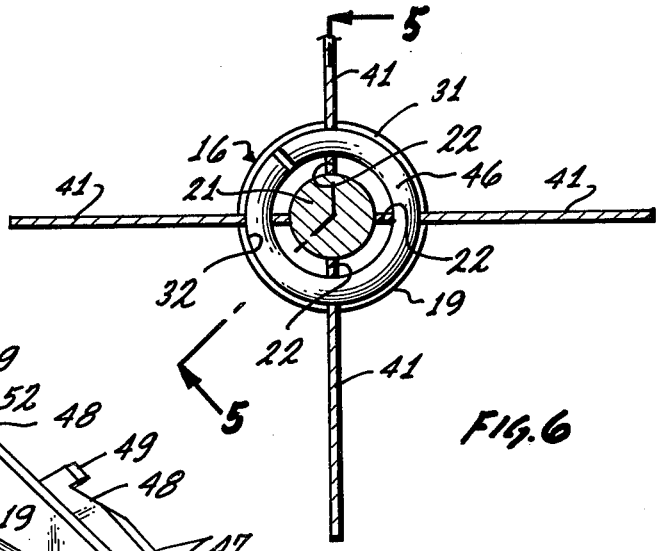
FIG. 6
FIG. 4
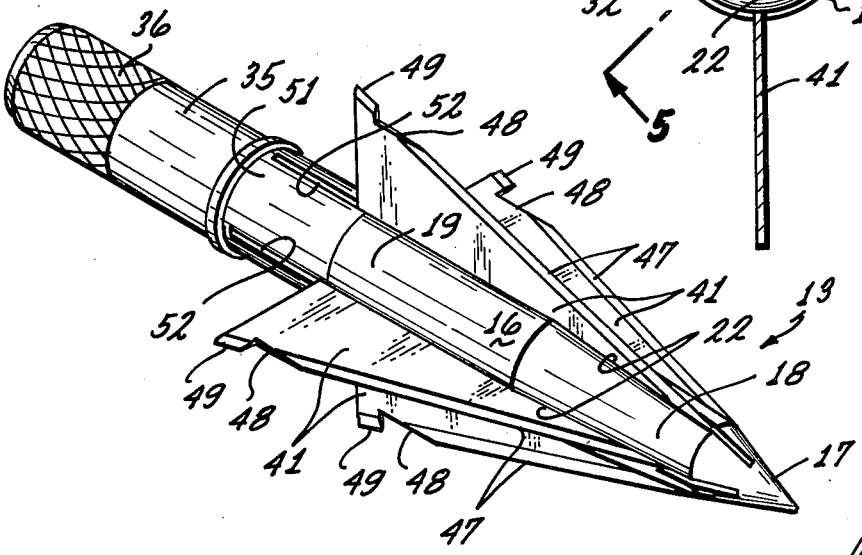
FIG. 7
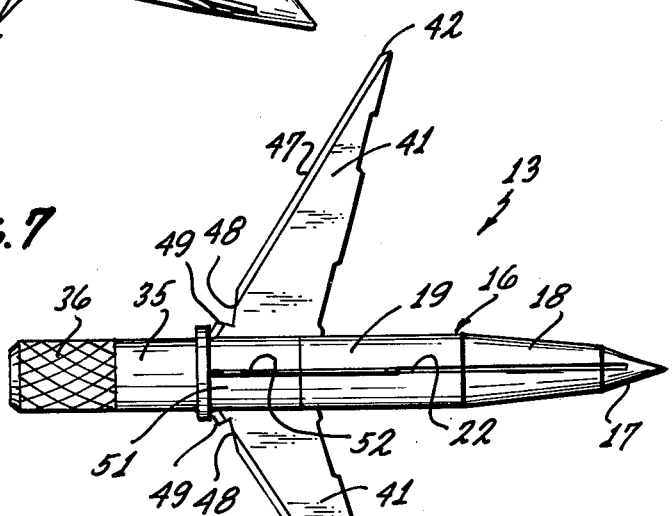
FIG. 5
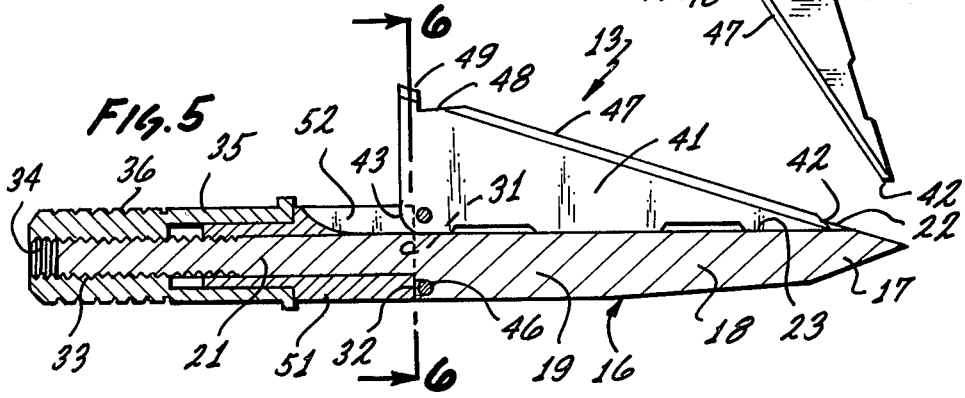

ARROWHEAD CONSTRUCTION

FIELD OF THE INVENTION

This invention relates to an arrowhead, and more particularly, to an arrowhead which has moveable parts. In this invention, arrowhead includes spearheads, integral arrows or spears and other projectiles for hunting which have a point designed for penetration.

BACKGROUND OF THE INVENTION

Archery, once practiced for survival, is a growing recreational sport. The limited projectile range of an arrow is a significant consideration in suburan areas where long range firearms may involve safety hazards. In turn, because of the archers limited range, a successful hunt becomes more of a challenge to the hunter because, after the animal is sighted, the hunter has to be sufficiently close, i.e. within range, to bag the animal. Everyone knows that getting close to a wild animal is difficult because wild animals have a built-in system for detecting danger. Therefore, since the hunter has a limited chance for success, he requires more and more efficient arrows so that any hit will be a fatal one.

Although these premises may appear crude to some, it is actually a more humane approach because a wounded animal is not only a danger to itself but also to any person who may stumble on one unexpectedly. Common knowledge tells us that a wounded animal runs and hides from danger, therefore making it difficult for the hunter to find the wounded animal. If the animal is not found it will, in all probability, die a slow death. Also, everyone knows that wild animals must be hunted during special seasons to keep the balance of nature and prevent the animals from dying of starvation because of limited food supplies.

Because of the above, many arrowheads have been developed to insure quicker death in animals. Although each prior art arrow has an advantage over each other remaining prior art, not one of the prior art arrows is 100% perfect in that all animals which are hit become game.

BRIEF SUMMARY OF THE INVENTION

The invention provides an arrowhead with two or more radially disposed, axially aligned flutes or blades extending from a dowel-like body. The blades taper towards the forward tip of the body to form an arrow with a true predictable flight. The blades are located symetrically around the body and parallel to and in the plane of the axis. The outer edge of each blade is sharpened. The blades are moveably secured to the body and are disposed in suitable slots formed in the body whereby a predetermined force can dislodge them. Each blade is pivotably mounted to the body at its aft or rear end whereby the blades are capable of pivoting radially outwardly and rearwardly.

OBJECTS OF THE INVENTION

An object of this invention is to provide an arrowhead with increased killing power and with a minimum of parts to make it economical.

Another object of this invention is to provide an arrowhead with a minimum resistance profile wherein all of the exposed edges have cutting capabilities and which flies a true path during flight.

Another object of this invention is to provide an arrowhead with radially extended blades which pivot outwardly and rearwardly after making a penetration into a target.

These and other objects and features of advantages will become more apparent after one studies the following description of the preferred embodiment of my invention together with the appended drawings.

BRIEF DESCRIPTION OF THE DRAWINGS

FIG. 4 is an enlarged pictorial view of my new arrowhead removed from the shaft of the arrow.

FIG. 5 is an axial section of the arrowhead shown in FIG. 4 and taken on a dihedral angle 5—5 as shown in FIG. 6 and in the direction of the arrows.

FIG. 6 is a sectional view taken on plane 6—6 as shown in FIG. 5 and in the direction of the arrows.

FIG. 7 is an axial view of the arrowhead after the blades have rotated outwardly.

DETAILED DESCRIPTION OF THE DRAWINGS

Figures 1, 2, 3:
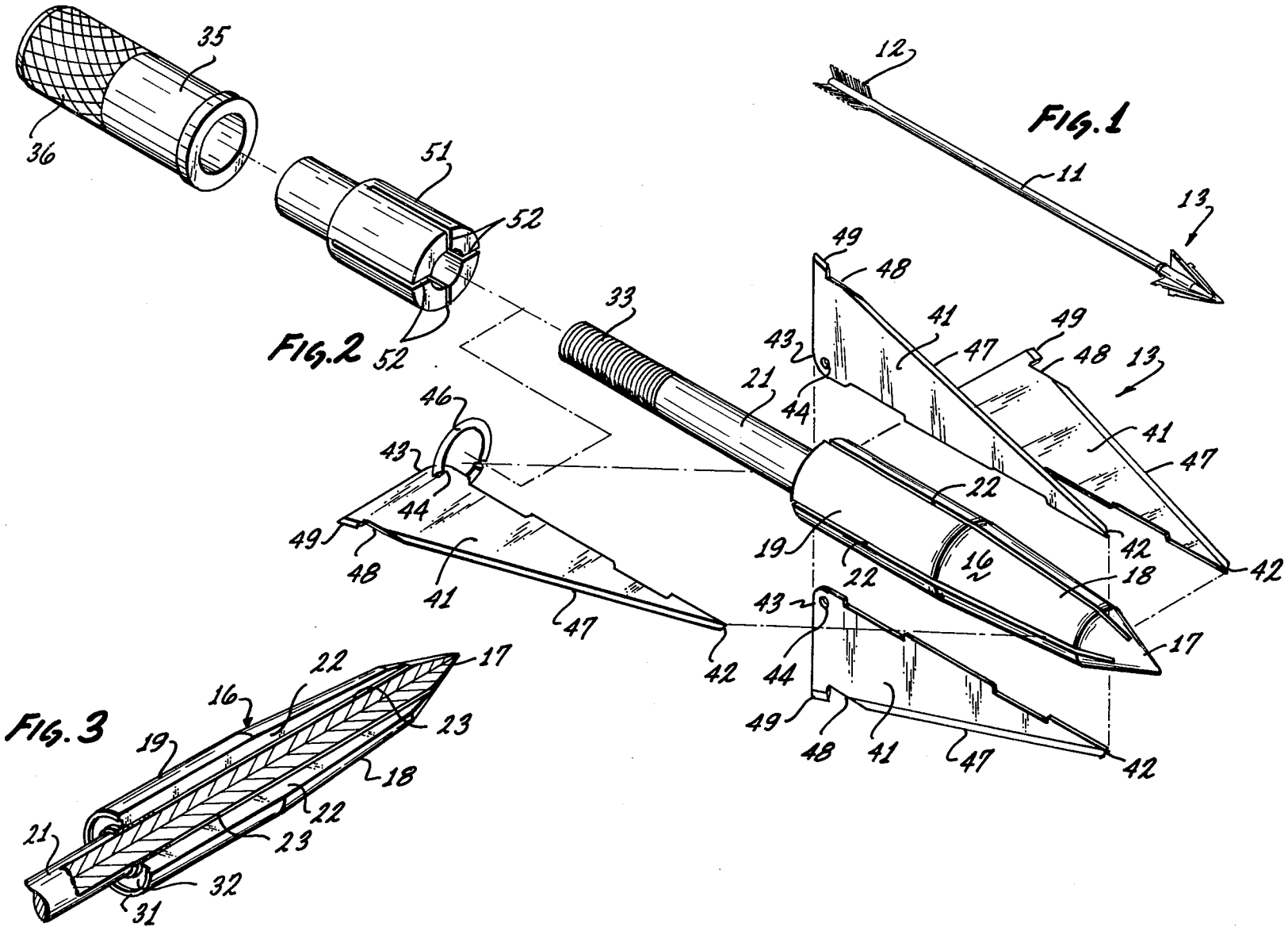
FIG. 1 is a pictorial view of an arrow employing my new arrowhead.
FIG. 2 is a pictorial exploded view of the arrowhead shown in FIG. 1.
FIG. 3 is a pictorial view of a conoidal head portion as employed in my new arrowhead showing the head portion with a 90° wedge removed therefrom to expose details.

A fully assembled arrow is shown in FIG. 1 and the arrow has a shaft 11 made of suitable standard material. Two or more tailfins 12 are symetrically spaced around the shaft 11 and my novel arrowhead 13 is disposed at the forward end of the shaft 11.

My novel arrowhead is more clearly illustrated in FIGS. 2 through 6 and the head 13 is made of a plurality of assembled parts which are shown in exploded view in FIG. 2. One of the parts of the arrowhead is a conoidal head portion 16 which is symetrical about an axis and has a cone tip 17 integrally attached to a fustro-conical section 18 which in turn is integrally attached to a cylindrical section 19. Integrally extending from the other end of section 19 is a stud 12 having a smaller diameter than section 19 for reasons that will become obvious. The head portion has, in this embodiment, four axially parallel slots 22 of which only two are shown in FIGS. 2 and 3 and, referring to FIG. 6, one can understand more clearly the symetrical location of the four slots relative to each other. The slots 22 are equally spaced around portion 16 and penetrate radially inward into portion 16 thereby a bottom surface 23 of each slot 22 is planar and axially parallel to the axis of portion 16. Each bottom surface 23 extends from tip 17 up to stud 21, as shown in FIGS. 3 and 5. Portion 16 has a rearward transverse surface 31 into which is formed a circumferential groove 32 whose function will become apparent hereinafter. The rear end of stud 21 is provided with threads 33 which, as will become obvious hereinafter, engage internal threads 34 (FIG. 5) of a sleeve 35. Suitable knurling 36 is formed on sleeve 35 so that the shaft 11 (FIG. 1) can be cemented thereto in a standard manner.

Within each respective slot 22 is removably disposed a blade 41 which is substantially shaped like a right angle. The blades 41 are frictionally held in respective slots 22. For example, the friction is provided by forming the thickness of the blades 41 slightly less than the width of the slots 22, thus providing for mass production and interchangeability of parts. Then, to ensure frictional engagement, a slight bow (not shown) is placed in each blade 41, i.e., from an angle 42 to a right angle 43, the surface of the blade 41 is bowed so that, when blade 41 is disposed within slot 22, as shown in FIGS. 4 and 5, the slot, being straight, straightens out the bow in the blade 41. In addition, to hold the blades 41 to the head portion 16, each blade has an aperture 44 formed as near to the right angle 43 as is practical whereby a slotted ring 46 is threaded through each aperture 44. In turn, the ring nests within groove 32 as shown in FIGS. 5 and 6. As noted in FIGS. 2 and 5 each right angle 43 on blade 41 is rounded for reasons that will become apparent hereinafter and the rounded corner allows each blade 41 to pivot rearwardly about ring 46 which acts as a pivot pin. In addition, each blade 41 is notched near the rear end as shown by a notch 48 to form a protrusion 49 whose function will become more apparent hereinafter.

To lock the blades 41 to the head portion 19 a sleeve-like thimble 51 is provided which has four axially aligned slits 52, the same manner as the number of slots 22 in portion 16. The thimble 51 is slipped over stud 21 so that slits 52 align with slots 22 and the rear portion of each respective blade 41 extends into a respective slit 52. Then the sleeve 35 is threaded onto the stud 21 as shown in FIG. 5 locking the parts of the assembled arrow together. The arrowhead 13 can now be mounted to shaft 11 in any standard manner.

OPERATION OF THE ARROWHEAD

Naturally when the arrow is mounted to the bow (not shown) the arrow looks like the arrow in FIG. 1 with the parts of the arrowhead positioned as shown in FIGS. 4, 5 and 6. On striking a target the arrowhead penetrates the target without any appreciable movements between its parts primarily because the outward exposed edges 47 of each blade are beveled and sharpened. When the blades 41 penetrate the target so that the rearward edge of the blades are about to enter the target, the protrusion 49 meets with a relatively large resistance causing each blade to pivot about the ring 46 to an axially outward position as shown in FIG. 7 causing a relatively large clean cut in a target.

After studying the above embodiment, one skilled in the art can devise other embodiments without departing from the spirit of my invention. Therefore, my invention is not to be considered limited to the disclosed embodiment, but includes all the embodiments coming within the scope of the appended claims.

I claim:

1. An arrowhead comprising:

a conical body symetrical about an axis and having a pointed forward end and first means formed at the rearward end capable of being attached to a shaft;

at least two rotatable blades mounted symetrically around said body and disposed to protrude radially outward;

second means for pivotably mounting said blades to said body so that said blades are capable of pivoting outwardly and rearwardly;

each of said blades are triangular in shape;

said body having at least two axially aligned slots symetrically disposed around said axis;

each of said blades having one side thereof disposed within one of said respective slots;

said second means comprising:

an axially aligned stud protruding from said body and having a diameter smaller than the diameter of said body to where said stud is attached;

each of said blades having an aperture formed relatively near the rearward angle of said blade which rearward angle is adjacent the said body;

a ring threaded through each of said apertures in said blades and said ring being disposed around said stud and adjacent said body;

a thimble disposed on said stud and against said ring; and thread means for retaining said thimble to said stud.

* * * * *